US007703422B2

(12) United States Patent
Latyshev

(10) Patent No.: US 7,703,422 B2
(45) Date of Patent: Apr. 27, 2010

(54) INTERNAL COMBUSTION ENGINE

(76) Inventor: Sergei Latyshev, Yasmin Alley, Jerusalem (IL) 93750

( * ) Notice: Subject to any disclaimer, the term of this patent is extended or adjusted under 35 U.S.C. 154(b) by 192 days.

(21) Appl. No.: 11/987,025

(22) Filed: Nov. 27, 2007

(65) Prior Publication Data

US 2008/0135024 A1 Jun. 12, 2008

Related U.S. Application Data

(63) Continuation of application No. 10/140,983, filed on May 9, 2002, now Pat. No. 6,793,471.

(51) Int. Cl.
*F01B 15/00* (2006.01)

(52) U.S. Cl. ..... 123/50 R; 123/50 A

(58) Field of Classification Search ..... 123/42, 123/50 R, 50 A, 50 B
See application file for complete search history.

(56) References Cited

U.S. PATENT DOCUMENTS 2,241,910 A * 5/1941 Hull ..... 123/50 R

* cited by examiner

*Primary Examiner*—Noah Kamen

(57) ABSTRACT

The proposed internal combustion engine may be characterized by two mobile opposite cylinders rigidly attached to each other. Said cylinders move simultaneously in the same direction. The motions of said cylinders are transferred via a connecting rod and hinges to the rotational movements of the crankshaft. Inside the opposite cylinders are two mobile opposite pistons rigidly attached to each other and rigidly secured to the housing of the engine. There are two working cavities of variable volume between the corresponding opposite pistons and the opposite cylinders. The intake and exhaust valves with intake and exhaust manifolds, injectors with fuel pipes, spark plugs with high voltage wires, are placed on the said pistons. The compressor is rigidly connected to the engine housing and supplies air under high pressure to the working cavities of the engine through the air intake manifold. During the operation of the engine, the intake and exhaust valves participate in providing the compression stroke and power stroke, when both valves are closed. When both valves are open (during the intake and exhaust strokes) the blowing of air under high pressure from the compressor takes place, in order to cool the working cavity of the engine. During the period of time between the closing of the exhaust valve at the end of the intake stroke and the closing of the intake valve at the beginning of the compression stroke, compressor supercharging of the working cavity of the engine takes place.

12 Claims, 7 Drawing Sheets

INTERNAL COMBUSTION ENGINE

This is a continuation of Ser. No. 10/140,983 filed May 9, 2002, now U.S. Pat. No. 6,793,471.

BACKGROUND OF THE INVENTION

1. Field of the Invention

The present invention refers to and can be used as an internal combustion engine.

2. Description of the Related Art

There are various designs of internal combustion engines in which the reciprocating movement is carried out by opposite cylinders:

WO 00/77366A1, in which two mobile cylinders are attached to each other in the area of the central transverse section and execute reciprocating movements relative to stationary pistons fixed to opposite sections of the housing. The heads of said pistons are directed toward each other. Working cavities between corresponding pistons and cylinders are interconnected through transfer ports and conduits which are located in the mobile cylinder.

U.S. Pat. No. 6,032,622 in which two mobile cylinders are mounted opposite each other on an elongated shaft cam (pin). The shaft cam (pin) is located between the transverse parts of the cylinders. Said cylinders carry out a reciprocating movement relative to the stationary pistons attached to the opposite parts of the housing. The heads of said pistons are directed toward each other.

There is also a "Fluid Machine" (See U.S. Pat. No. 6,793,471 B2, Israel Pat. No 128763) in which two mobile opposite cylinders are rigidly attached to each other. The transverse closed parts of said cylinders are located on the outside ends thereof. Said cylinders execute reciprocating movements which always occur simultaneously in the same direction. Inside the opposite cylinders are two stationary opposite pistons which are attached to each other and rigidly secured to the housing. The proposed invention constitutes a continuation and addition to said invention "Fluid Machine" and represents a way of application thereof as an "Internal Combustion Engine".

SUMMARY OF THE INVENTION

The present internal combustion engine comprises a housing. The crankshaft is secured to the seats of the housing by means of bearings and is connected to the mobile opposite cylinders by means of a crank hinge, a connecting rod and an axial hinge. Two mobile opposite cylinders are rigidly attached to each other. The transverse closed parts of said cylinders are located on the outside ends thereof. Said cylinders execute reciprocating movements which always occur simultaneously in the same direction. Two stationary opposite pistons are attached to each other in the area of their skirts, from where rods, passing through the holes in the walls of the opposite cylinders outside the limits of the working cavities, are rigidly secured to said housing. The heads of said pistons are directed outward. The intake and exhaust valves with intake and exhaust manifolds, injectors with fuel pipes, spark plugs with high voltage wires are placed on said pistons. Two non-interconnected working cavities are situated between the corresponding piston and cylinder. The air intake manifolds, which are located inside said opposite pistons, join the working cavity of the compressor to said working cavities of the engine. The engine exhaust manifolds, located inside said opposite pistons, join the working cavities of the engine with the exhaust pipe. The compressor is rigidly connected to the engine housing and obtains rotational movements from said engine crankshaft via the transmission gears. The said compressor has an air intake pipe with an air filter designed to supply clean ambient air to the working cavity of the compressor. Said compressor, under high pressure, supplies air through said air intake manifolds to said working cavities of the engine. Said intake and exhaust valves are set in motion by means of camshaft cams of a gas distribution system and are designed for gas distribution, compressor supercharging during engine operation and cooling the walls of said working cavities of the engine and engine exhaust manifolds by blowing air under high pressure from said compressor. While the engine operates, during the power stroke, both valves are closed. At the end of the power stroke, the exhaust valve opens. Hot gases start to leave the working cavity through the engine exhaust manifolds. At the beginning of the next exhaust stroke, the intake valve opens. From the air intake manifold, cold air from the compressor starts blowing into the working cavity under high pressure. Both valves remain open during the exhaust stroke and the following intake stroke. At this time, the blowing of high-pressure cold air continues, so as to cool the working cavity and the engine exhaust manifold. At the end of the intake stroke, the exhaust valve closes. The blowing of air into the working cavity stops. Clean air under pressure fills the working cavity through the air intake manifold and open intake valve. At the beginning of the following compression stroke intake valve closes. During the period of time between closing the exhaust valve at the end of the intake stroke and closing the intake valve at the beginning of the compression stroke, the compressor supercharging function takes place. At the end of the compression stroke, the fuel mixture is injected into the working cavity through an injector, and the fuel mixture immediately is ignited by an electric spark from the spark plug. The power stroke begins and the entire process repeats itself. At the same time, the entire process set forth above is also taking place in the other working cavity of the engine.

DETAILED DESCRIPTION OF THE PREFERRED EMBODIMENTS

Figure 1:
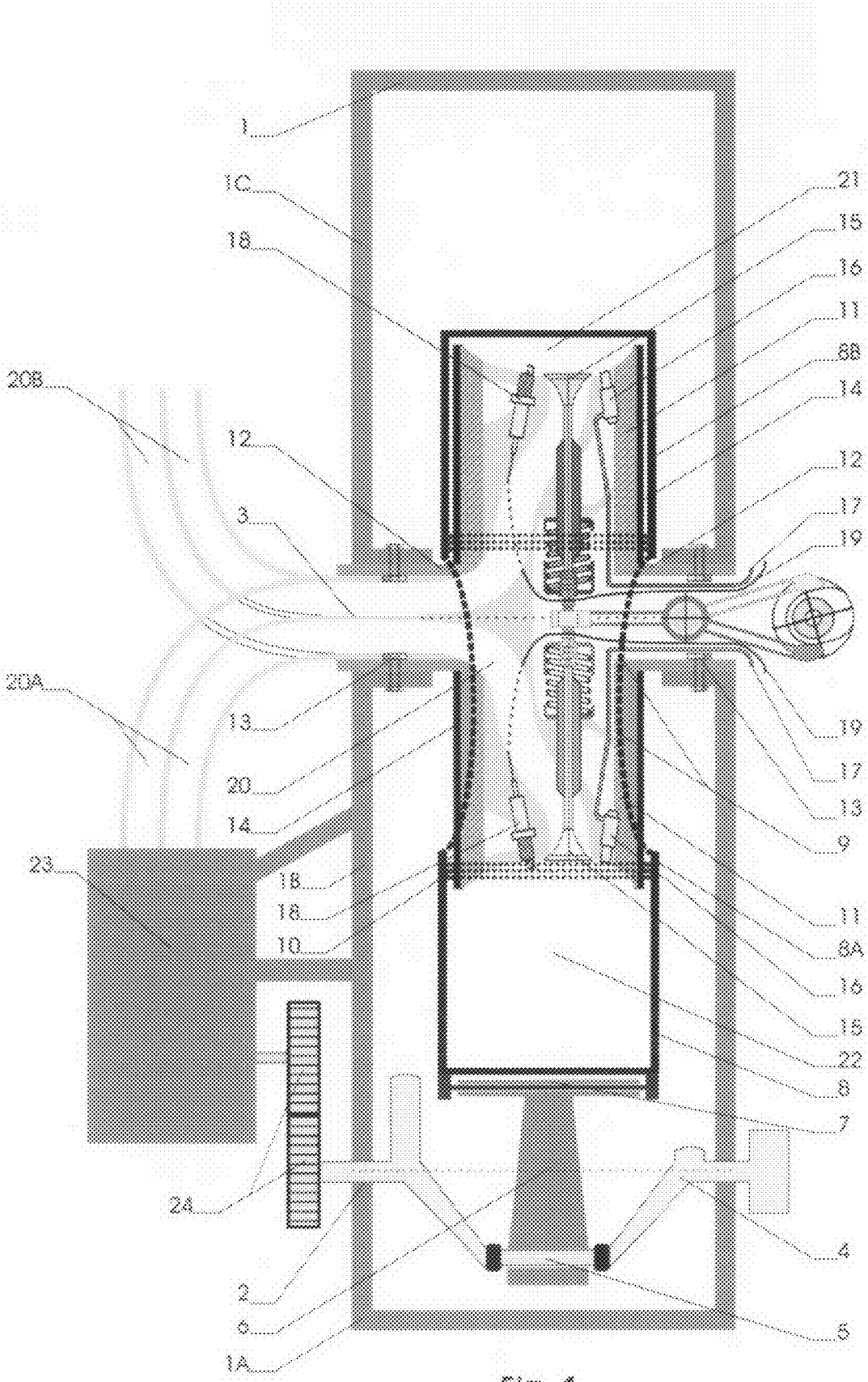
FIG. 1 is a sectional view of the present internal combustion engine according to the present invention.
Figure 2:
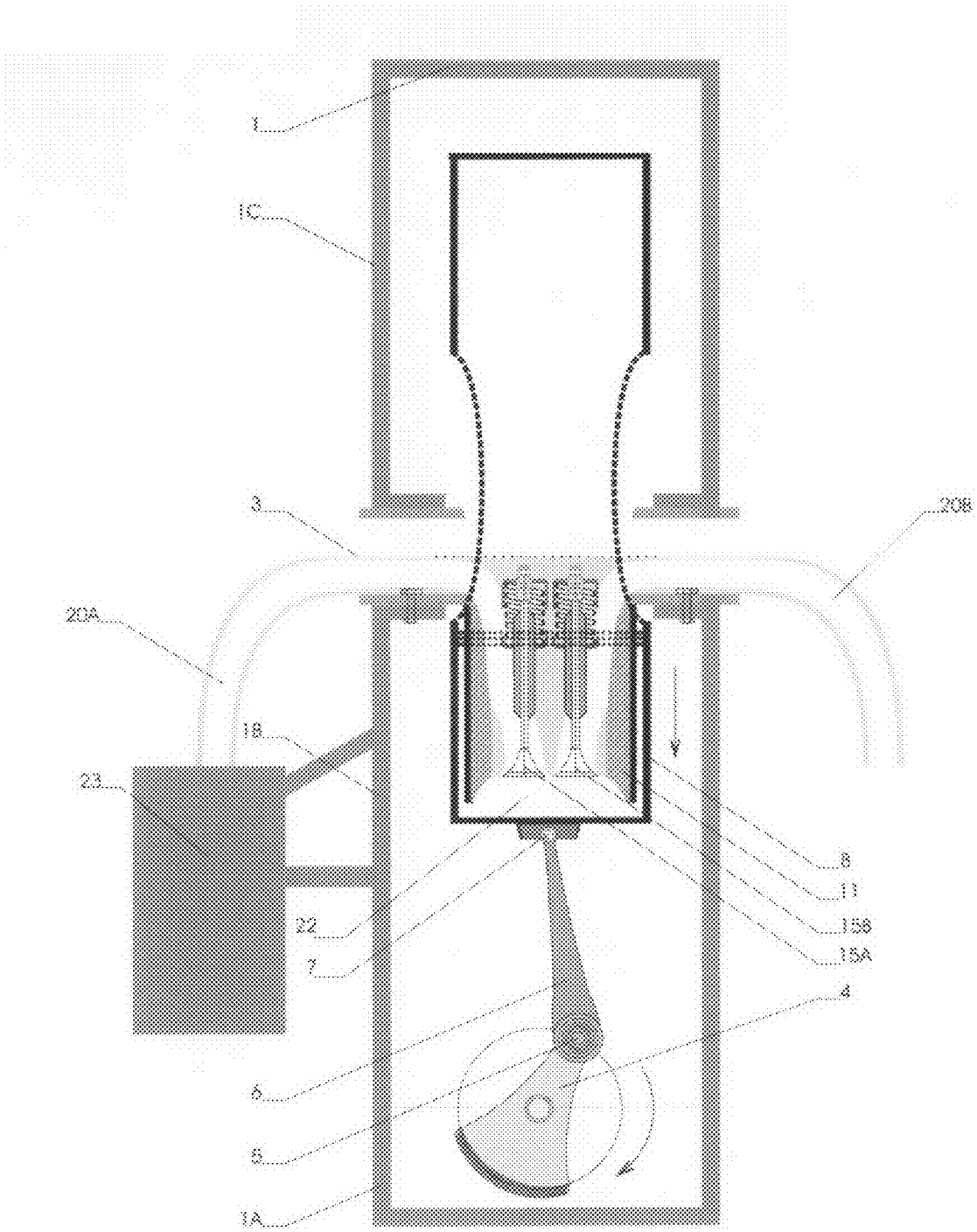
FIG. 2 is a sectional view of the present internal combustion engine showing the back mobile cylinder, the stationary piston with the valves and manifolds during the operation at the beginning of the power stroke.

The present internal combustion engine (see FIGS. 1, 2) comprises a housing 1. The housing of the engine according to the present invention consists of three parts—back 1A, middle 1B and front 1C. Between the parts of the housing are gaskets (not shown). The parts of the housing are attached with screws and bolts (not shown). Between the back part 1A and the middle part 1B on both sides of the housing are seats 2 for crankshaft bearings. Between the middle part 1B and the front part 1C on both sides of the housing are round recesses 3 with holes in the middle.

The crankshaft 4 is secured to the seats 2 of the housing by means of bearings (not shown). The crankshaft is connected by means of a crank hinge 5, the connecting rod 6 and an axial hinge 7 to the mobile cylinder body 8.

The cylinder body 8 and the opposite cylinders 8A, 8B entering it are made of light metal alloys. Said cylinders are rigidly attached to each other. The transverse closed parts of said cylinders are located on the outside ends thereof. On both sides thereof, in the middle part, are oval holes 9. On the inside in the back and front parts are channel-shaped recesses in the wall which are used to attach two types of rings 10 (compression and oil control rings). Inside the opposite cylinders 8A, 8B of the cylinder body 8 are two stationary opposite pistons 11, which are attached to each other in the area of their skirts, from where rods 12, passing through holes 9 in the walls of the opposite cylinders, are rigidly secured to said housing 1 with screws and bolts 13 in the recess area 3 of the engine housing. The heads of said pistons are directed outward. The side piston surfaces are sliding working surfaces 14 made of high-strength steel. Each said piston is made with an intake valve 15A and an exhaust valve 15B, which are set in motion by means of camshaft cams of a gas distribution system. The injectors 16 are placed on said heads of opposite pistons with fuel pipes 17, located inside the opposite pistons, and exit from the engine through the hole in the recess area 3 of the engine housing 1. The spark plugs 18 are placed on said heads of the opposite pistons with high voltage wires 19, located inside the opposite pistons, and exit from the engine through the hole in the recess area 3 of the engine housing 1. Inside the pistons, the air intake manifolds 20A extending from the intake valves 15A exit from the engine through the hole in the recess area 3 of the engine housing 1 and are connected to the working cavity of the compressor. Inside the pistons, the engine exhaust manifolds 20B extending from the exhaust valves 15B exit from the engine through the hole in the recess area 3 of the engine housing 1 and are connected to the exhaust pipe of the engine. The cavities between the corresponding opposite pistons 11 and the internal surface of the opposite cylinders 8A, 8B of the cylinder body 8 represent non-interconnected working cavities. The design of the present invention includes two working cavities—front 21 and back 22. A compressor 23, rigidly connected to the engine housing 1, receives rotational movement from said engine crankshaft 4 through transmission gears 24. Said compressor 23 has an air intake pipe (not shown) with air filter (not shown) designed to supply clean ambient air to the working cavity of the compressor (not shown). Said working cavity of the compressor is connected via said air intake manifolds 20A and holes to intake valves 15A, which are connected to the front 21 and back 22 working cavities of the engine.

Figure 3:
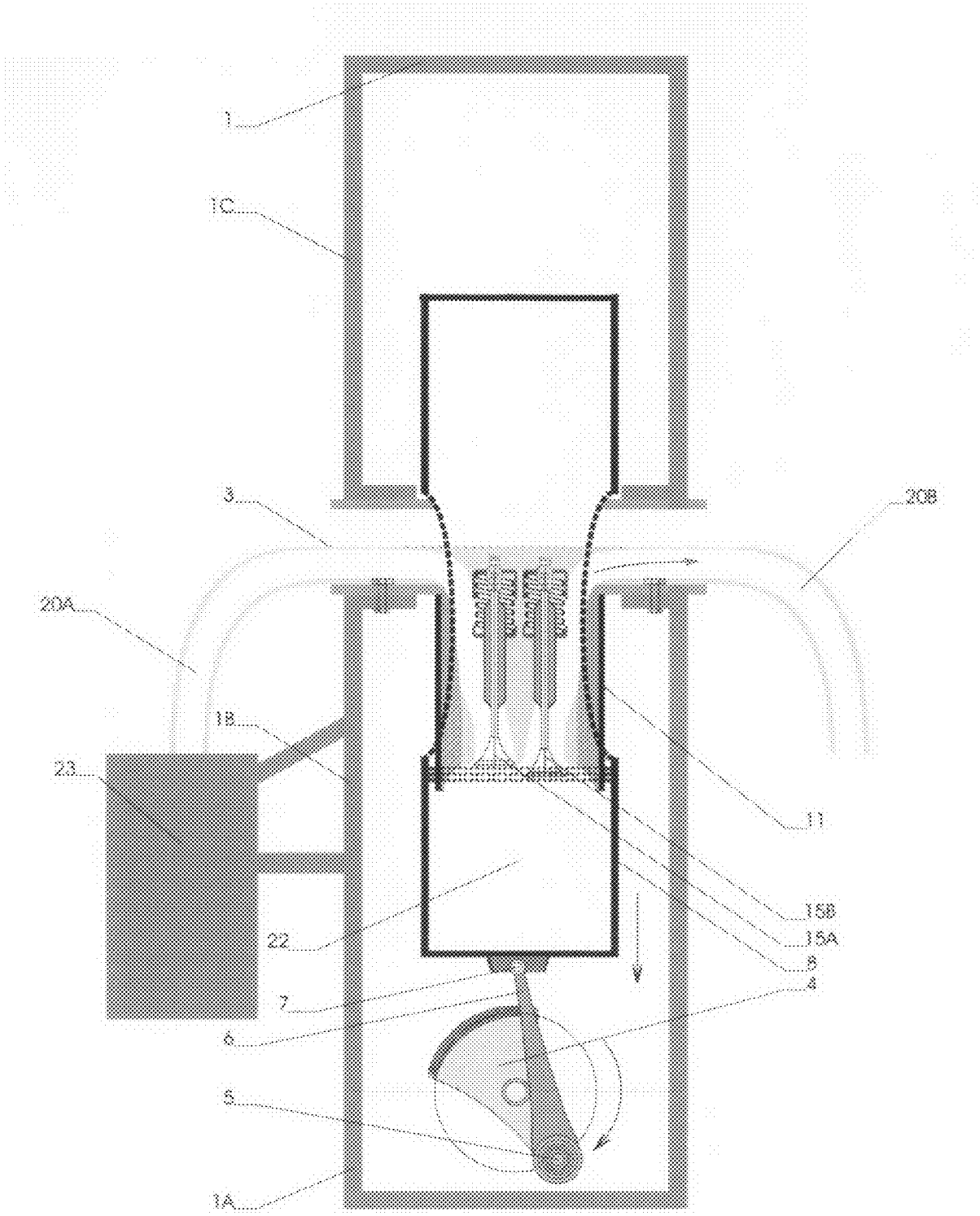
FIG. 3 is a view of FIG. 2 at the end of the power stroke.
Figure 4:
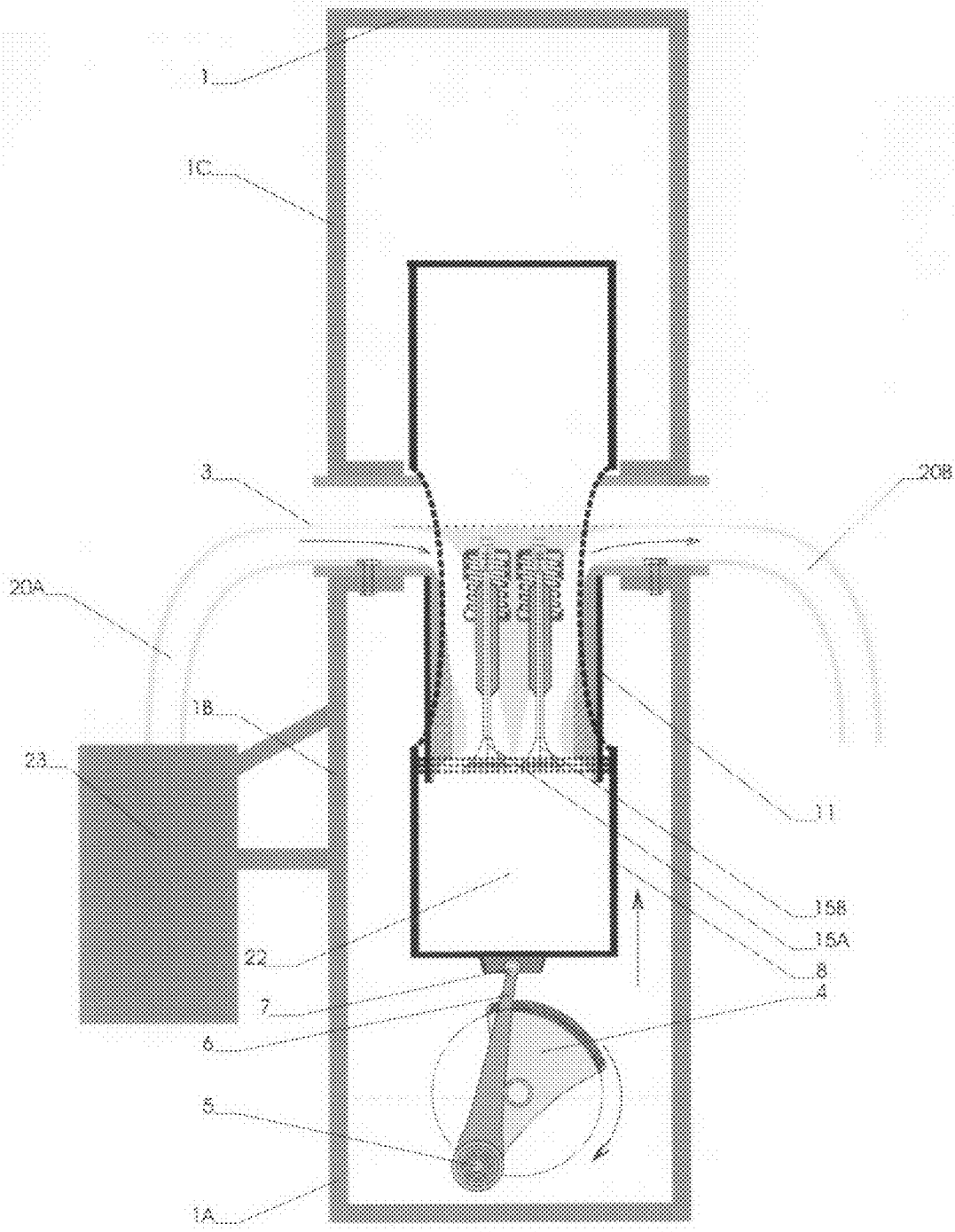
FIG. 4 is a view of FIG. 2 at the beginning of the exhaust stroke.
Figure 5:
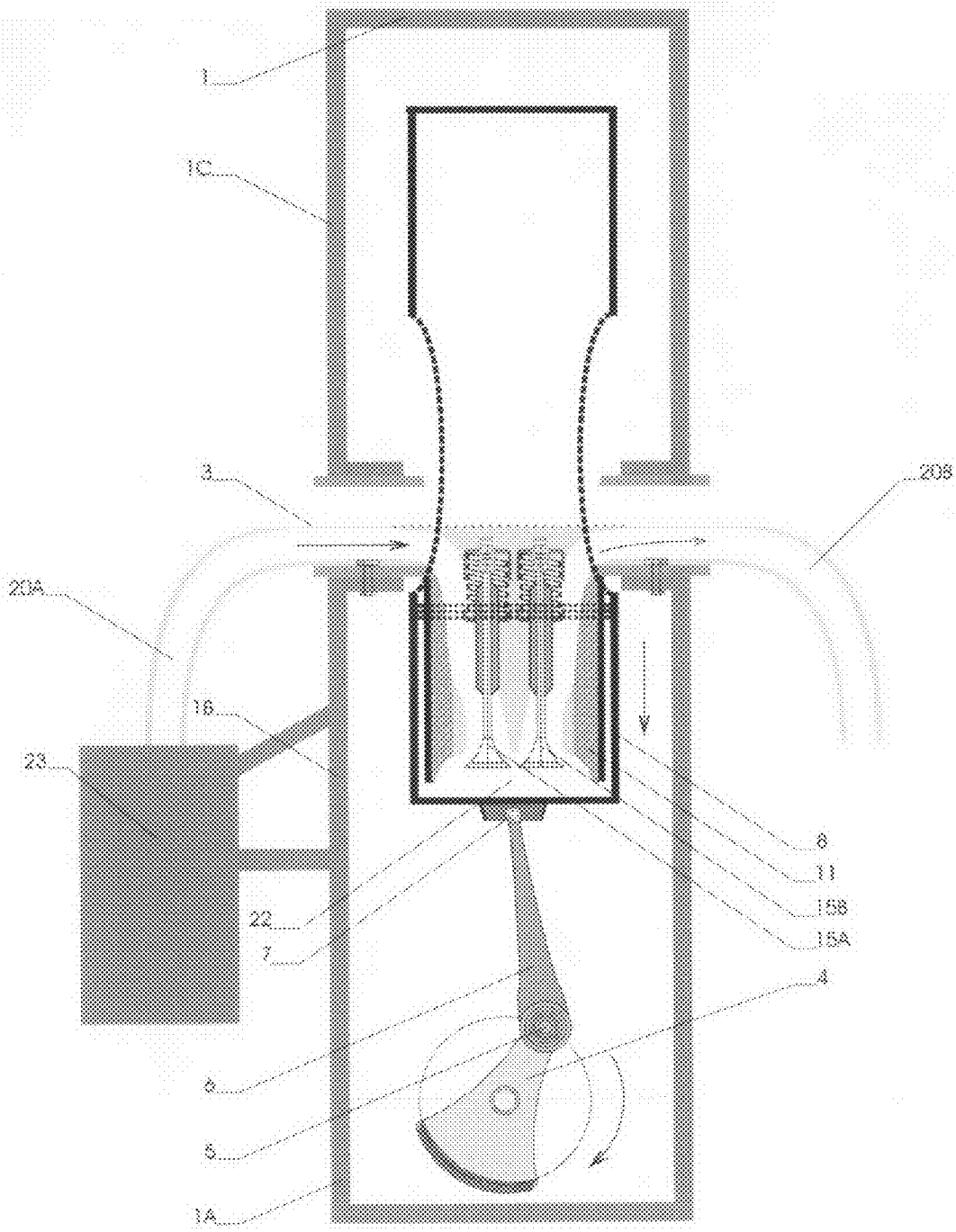
FIG. 5 is a view of FIG. 2 at the beginning of the intake stroke.
Figure 6:
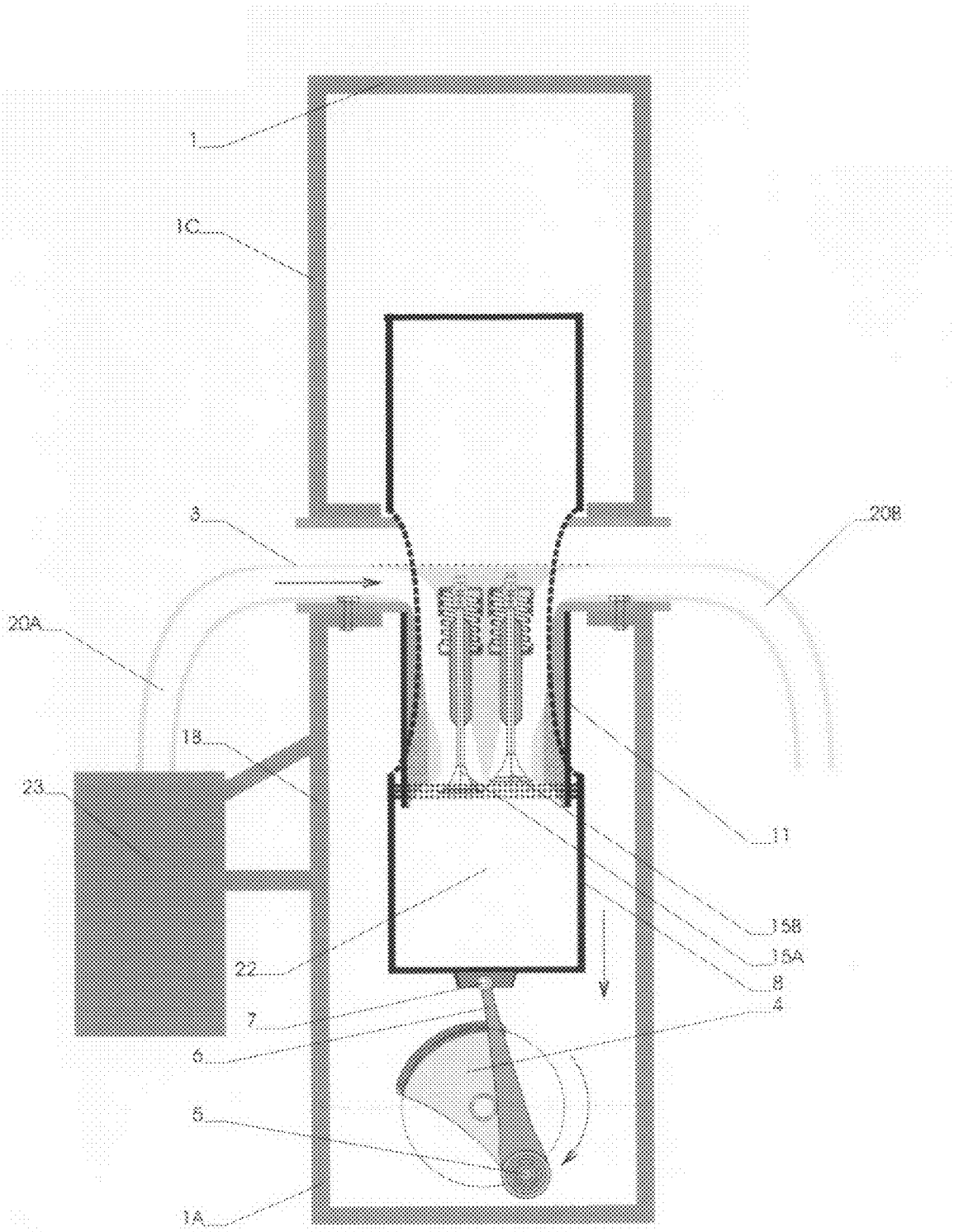
FIG. 6 is a view of FIG. 2 at the end of the intake stroke.
Figure 7:
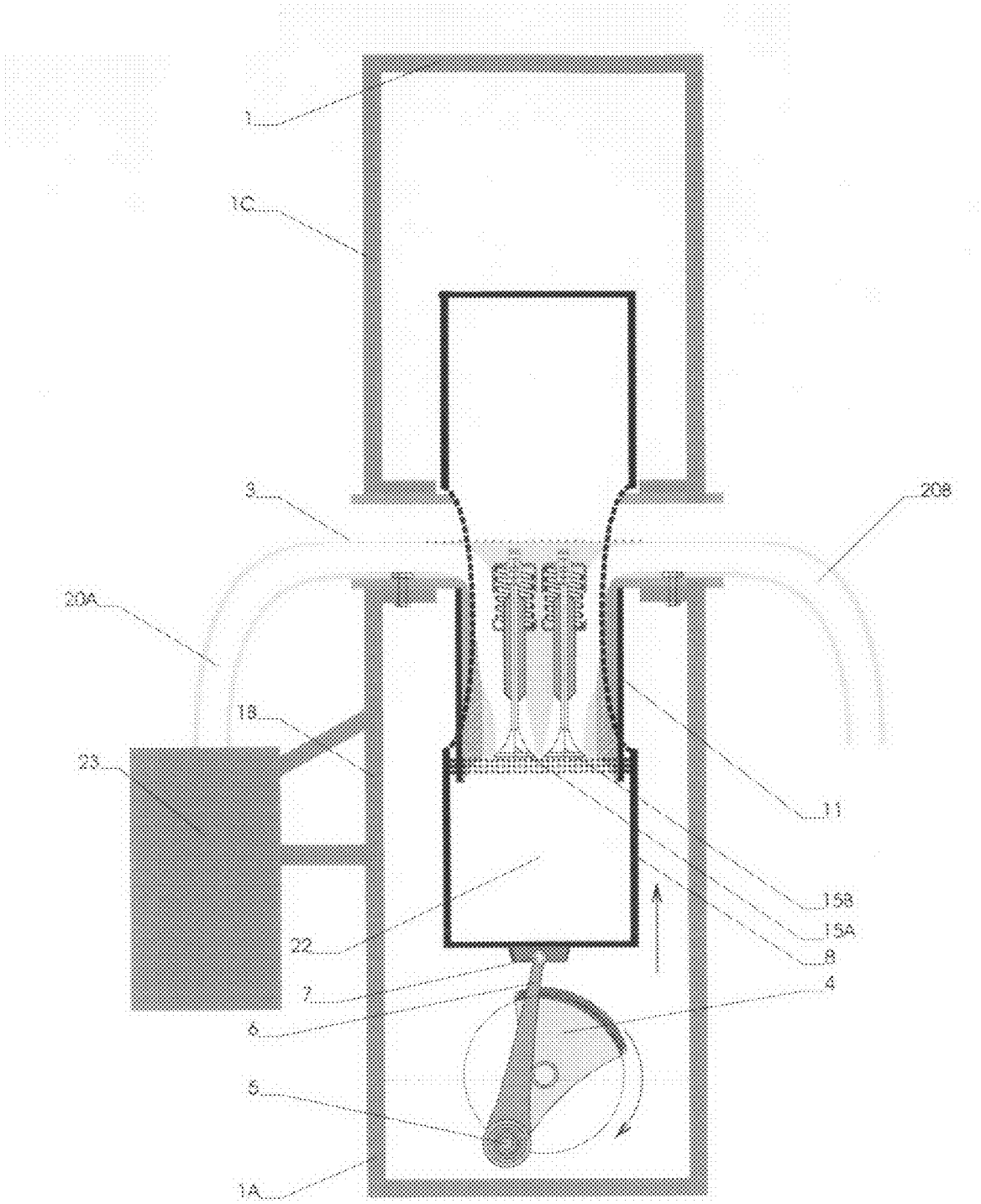
FIG. 7 is a view of FIG. 2 at the beginning of the compression stroke.

Principle of operation of the present internal combustion engine: While the engine operates, the compressor 23 is set into motion by means of the transmission gear 24 from the crankshaft 4 of the engine. Through the air intake pipe and air filter, the ambient air enters the compressor working cavity and is subsequently boosted under high pressure into air intake manifolds 20A leading to front 21 and back 22 working cavities of the engine. During the explosion of the gas mixture in the back working cavity of the engine and the power stroke (see FIG. 2), the intake valve 15A and exhaust valve 15B are closed. Under the action of hot gas pressure, the mobile cylinder 8 starts moving downwards from the fixed piston 11. At this time, the walls of the back working cavity 22 are heated with hot gases. At the end of the power stroke (FIG. 3), the exhaust valve 15B opens. Hot gases start to exit the back working cavity 22 and combine with the ambient air through the engine exhaust manifold 20B. The gas pressure in the back working cavity 22 drops. At the beginning of the next exhaust stroke (see FIG. 4), when the mobile cylinder 8 starts moving in the opposite direction (upward), the intake valve 15A opens. From the air intake manifold 20A, cold air from the compressor 23 starts blowing into the back working cavity 22 under high pressure. At this time, both valves 15A, 15B are open. Cold air cools the walls of the back working cavity 22 and leaves through the engine exhaust manifold 20B, cooling its walls as well. Both intake 15A and exhaust 15B valves remain open and the blowing of high-pressure cold air into the back working cavity 22 and the engine exhaust manifold 20B continues while the mobile cylinder 8 is in the upper position. During the next intake stroke (see FIG. 5), when the mobile cylinder 8 moves downwards, both valves 15A, 15B remain open. The blowing of high-pressure cold air onto the walls of the back working cavity 22 and the engine exhaust manifold 20B continues. At the end of this stroke (see FIG. 6), when the mobile cylinder 8 moves downwards, the exhaust valve 15B closes. The blowing of air into the back working cavity stops. Clean air under pressure fills the back working cavity 22 through the air intake manifold 20A and the open intake valve 15A. At this time, compressor supercharging of the back working cavity of the engine occurs. At the beginning of the following stroke (see FIG. 7), when the mobile cylinder 8 starts moving upward, the intake valve 15A closes. Now both the intake 15A and exhaust 15B valves are closed. The mobile cylinder 8 continues its movement upwards, accomplishing the compression stroke. At the end of the compression stroke, the fuel mixture is injected into the back working cavity 22 through a fuel pipe 17 and an injector 16, and the fuel mixture is immediately ignited by an electric spark from the spark plug 18. The pressure and temperature in the back working cavity rise sharply. The mobile cylinder 8 moves downwards and the power stroke begins. The entire process repeats itself. While the engine is in operation, all of the processes described above which occur in the back working cavity of the engine also take place in the front working cavity thereof.

Thus, when the present internal combustion engine is in operation, during the power stroke the walls of the working cavity are heated with hot gases; and during exhaust stroke and intake stroke, or about 50% of the time, the walls of the engine working cavities and exhaust manifolds are cooled (by blowing with air under pressure). Since the compressor is connected to the engine crankshaft by means of a transmission gear, the blowing of air under pressure, in order to cool the walls of the engine working cavities and exhaust manifolds, increases as the engine revolutions increase.

In the present internal combustion engine, four strokes of the engine take place during each full travel of the crankshaft (two in the front and two in the back working cavities of the engine).

The proposed engine is also more ecologically clean than the internal combustion engines used at the present time. This is because, during the exhaust stroke, air under high pressure is blown through the engine. The unburned (suboxidated) particles of fuel hydrocarbons which remain after the power stroke combine with the oxygen in the air in the process of delayed burning (oxidation). As a result, the exhaust gases of the engine will contain a far smaller quantity of hazardous emissions which pollute the environment.

What is claimed is:

1. An internal combusting engine comprising:

a housing having seats;

a crankshaft secured to the seats with possibility for rotational movement and for outputting a rotational moment;

a couple of movable cylinders disposed oppositely and rigidly connected to each other, said cylinders being delimited by respective walls and one of said cylinders being operatively coupled with the crankshaft;

a couple of stationary pistons associated with the cylinders and having respective heads, skirts and rods, said pistons being disposed oppositely and connected there between in the area of their skirts, and their rods being rigidly secured to said housing, said rods passing through a holes made in the walls of the cylinders, said cylinders and pistons delimiting together a couple of working cavities of the engine;

wherein the heads of said pistons are directed outside from each other and within each of said heads is deployed an intake valve and an exhaust valve;

a couple of air intake manifolds, which are in fluid communication with the pistons for entry of fresh air into working cavities of the engine;

a couple of engine exhaust manifolds, which are in fluid communication with the pistons for removal of exhaust gases from working cavities of the engine;

a couple of injectors located in respective heads of the pistons for supply a fuel mixture to respective working cavities of the engine;

a couple of spark plugs located in respective heads of the pistons with high voltage wires for ignition of the fuel mixture in the working cavities;

a compressor for supply of air under pressure through the said air intake manifolds into working cavities:

a gas distribution system, having a camshaft with cams, wherein said intake valves and exhaust valves being displaceable by cams of the camshaft and said gas distribution system is suitable both for gas distribution, compressor supercharging during operation of the engine and for cooling of walls of said working cavities and of the exhaust manifolds by blowing air under pressure from the compressor.

2. An internal combustion engine of claim 1, wherein said crankshaft is operatively coupled to the one of said cylinders through a crank hinge, a connecting rod and an axial hinge.

3. An internal combustion engine of claim 1, wherein said crankshaft is operatively coupled through a plurality of transmission gears with the compressor.

4. An internal combusting engine of claim 1, wherein transverse closed parts of the cylinders are delimited by their outside ends.

5. An internal combusting engine of claim 1, wherein said cylinders are capable to simultaneously and reciprocatively displace in the same direction.

6. An internal combusting engine of claim 1, wherein each of said intake valves has a first hole and said air intake manifolds are in fluid communication with the working cavities through the first hole.

7. An internal combusting engine of claim 1, wherein each of said exhaust valves has a second hole and said exhaust manifolds is in fluid communication with the working cavities through the second hole.

8. An internal combusting engine of claim 1, wherein said compressor receives rotational movement from said engine crankshaft.

9. An internal combusting engine of claim 1, wherein said compressor has an air intake pipe provided with an air filter for supply clean ambient air to the compressor.

10. An internal combusting engine of claim 1, wherein during a compression stroke and a power stroke of the engine said intake and exhaust valves are closed.

11. An internal combusting engine of claim 1, wherein during an exhaust stroke and an intake stroke of the engine said intake and exhaust valves are open to enable blowing the walls of the working cavities and engine exhaust manifolds with air under high pressure supplied from said compressor.

12. An internal combusting engine of claim 1, wherein supercharging of the compressor takes place during a period of time between closing the exhaust valve at an end of the intake stroke and closing the intake valve at a beginning of the compression stroke.

* * * * *